US006315206B1

(12) United States Patent
Hansen et al.

(10) Patent No.: US 6,315,206 B1
(45) Date of Patent: Nov. 13, 2001

(54) WALLET CARD PACKAGE

(75) Inventors: Roger P. Hansen; Nicholas J. Malone, both of Rockford, MI (US)

(73) Assignees: Barry Fiala, Inc., Memphis, TN (US); Moore North America, Inc., Grand Island, NY (US)

( * ) Notice: Subject to any disclaimer, the term of this patent is extended or adjusted under 35 U.S.C. 154(b) by 0 days.

(21) Appl. No.: 09/448,697

(22) Filed: Nov. 24, 1999

(51) Int. Cl.[7] ..... G06K 19/00
(52) U.S. Cl. ..... 235/487; 235/380; 283/61
(58) Field of Search ..... 235/380, 487; 283/61

(56) References Cited

U.S. PATENT DOCUMENTS

D. 394,387 * 5/1998 Williams .
3,726,471 * 4/1973 Kalb ..... 150/139
5,431,207 * 7/1995 Siegel ..... 150/139
5,720,158 * 2/1998 Goade, Sr. .
5,740,915 * 4/1998 Williams .
5,760,381 * 6/1998 Stich et al. .
5,777,305 * 7/1998 Smith et al. .
5,791,474 * 8/1998 Hansen .
5,842,629 * 12/1998 Sprague et al. .
5,918,909 * 7/1999 Fiala et al. .
5,921,584 * 7/1999 Goade, Sr. .
6,068,192 * 5/2000 McCabe et al. ..... 235/380

FOREIGN PATENT DOCUMENTS

128672 * 5/1984 (EP) .

* cited by examiner

*Primary Examiner*—Harold I. Pitts
(74) *Attorney, Agent, or Firm*—Norris, McLaughlin & Marcus P.A.

(57) ABSTRACT

A wallet card package having a wallet card secured to a panel. The panel includes a card flap that is pivotal about a fold line. The card is secured to and carried by the card flap so that the package is selectively movable from a closed position in which an magnetic strip on the card is covered and an open position in which the card is swung out from the panel while remaining secured to the card flap such that the magnetic strip is exposed for activation purposes. The card may be disposed between a pair of panels, with the front panel defining an opening permitting viewing of the front surface of the card and the rear panel including a cover flap that covers the magnetic strip when the package is in the closed position.

29 Claims, 11 Drawing Sheets

WALLET CARD PACKAGE

BACKGROUND OF THE INVENTION

The present invention relates to packaging and more particularly to a package for wallet cards such as phone cards, bank cards, credit cards, and debit cards.

Wallet cards are well known and widely used for a variety of purposes. For example, wallet cards have long been used as credit cards, debit cards, rental cards and bank cards. Wallet cards are also used to represent a variety of pre-paid services. Prominent examples of this are pre-paid phone cards, which are offered by a number of leading phone service providers, and pre-paid gift cards, which are available from a wide range of companies. To reduce the risk of theft, pre-paid cards are typically shelved, or displayed, in an inactive status. As a result, pre-paid cards usually require activation before they will function. Typically, activation is performed at the time of purchase by reading a unique identification number encoded on the card. This method is widely referred to as "point-of-sale activation." The identification number is generally stored on a magnetic strip or encoded into a bar code printed or attached to the rear of the card. The identification number is read by a card reader (e.g. a magnetic card reader, bar code scanner, or the like) and then transmitted to a central computer which activates the card. Once activated, the card entitles the holder to redeem the associated goods or services in the amount of the value assigned to the card. Each time the card is used, the central computer is notified and the value of the goods or services purchased are deducted until the card's value has been depleted.

A variety of phone card packages are commercially available that facilitate point-of-sale activation of the pre-paid card by packaging the card so that the identification number is accessible for reading without removing the card from the package. One such type of phone card package 200 includes front 202 and rear (not shown) panels that sandwich the upper portion 204 of the card 206 (See FIG. 1). The lower portion 208 of the card 206 (to which the magnetic strip is attached) protrudes from the package 200 so that it can be passed through a card reader without removing the card from the package 200. The front panel 202 includes a transparent plastic window 210 that covers the top of card 206 and permits viewing of graphics printed thereon. To prevent the card 206 from being pulled out of the package 200, the card 206 is secured to the package 200. In a particularly advantageous construction, the card 206 is secured to the panels by a layer of peelable adhesive (not shown). In other constructions, the card is secured to the panels by adhesive tape or by a portion of the window that extends through a hole in the card. The plastic window significantly increases the cost of this package. Also, because the identification number is always accessible, it is difficult to determine if the card has been tampered with, for example, if it has previously been activated. Further, because the portion of the card carrying the identification number extends freely from the card, the identification number can be intentional or inadvertently damaged during shipping, handling and display, for example, by scratching the magnetic strip. Additionally, after the card is purchased, it is relatively difficult to remove the card from the package because the front and rear panels must be separated to gain access to the card.

A second type of point-of-sale phone card package 300 includes panels that can be folded about the card 302 to provide access to the identification number (See FIGS. 2 and 3). The card 302 is sandwiched between front 304 and rear (not shown) panels, and includes a magnetic strip (not shown) extending across the top, rear of the card 302. The rear panel covers the rear of the card and includes a fold line (not shown) that permits it to fold backward at a point below the magnetic strip. The front panel defines a card-sized opening 306 that receives the card 302. A transparent window 308 is positioned in the opening 306 to help retain the card. Because the upper portion of the package 300 is required to fold away from the card 302, the window 308 extends through only a portion of the opening 306 and its upper extent 312 coincides with the fold line in the rear panel. The front panel 304 also includes a line of perforations 310 that coincides with the fold line in the rear panel and the upper extent 312 of the window 308. The perforations 310 permit the front panel 304 to tear apart when the package 300 is folded to provide access to the magnetic strip (See FIG. 3). This makes it easier to fold the package 300 and prevents the rear panel from buckling or creasing when folded. Although this construction protects the card prior to activation, the transparent window increases the cost of the package. Further, the presence of only a partial window may be aesthetically unpleasing to customers. Also, because the front panel is torn apart at the line of perforations, the integrity and aesthetic appearance of the package is compromised when the card is exposed. Additionally, once the package has been folded open, the panels hang limply providing little or no protection for the card. Further, after the card is purchased, it is relatively difficult to remove the card from the package because the front and rear panels must be separated to gain access to the card.

SUMMARY OF THE INVENTION

The aforementioned problems are overcome by the present invention wherein a wallet card package is provided with a card flap that permits the wallet card to flip out from between the front and rear panels for point-of-sale activation while remaining secured to the package. The package includes front and rear panels that enclose the card. The rear panel includes a card flap that can be selectively swung out from the rear of the package. The wallet card is secured to and carried by the card flap such that the wallet card moves with the flap.

In a preferred embodiment, the card flap extends only partially up the rear surface of the card such that the identification number is exposed when the card flap is swung out from the package. The rear panel preferably includes a cover flap that covers the portion of the wallet card not covered by the card flap when the card flap is closed. The card and cover flaps are preferably defined by a series of cuts, perforations or other weakened lines in the rear panel. This permits the card flap to be opened simply by applying a rearward force on the front surface of the card.

In another preferred embodiment, the front panel defines an opening that permits viewing of the front surface of the packaged card. The opening is slightly smaller than the card so that it provides maximum viewing area while preventing the card and flap from being folded forwardly.

In an alternative embodiment, the card flap can be configured to permit the card to be flipped out in a forward direction rather than rearward direction. In this embodiment, the front panel is either eliminated or is provided with a card opening that is large enough to permit passage of the card.

The present invention provides a simple, inexpensive wallet card package that protects the rear surface of the wallet card until the card flap is opened for activation. At the time of activation, access to the identification number is easily achieved by applying a rearward force to the front surface of the card and swinging the card into a plane substantially perpendicular to the plane of the package. When perforations or partial cuts are included in the package, they provide the package with a tamper-evident seal because the perforations or partial cuts must be broken to open the card flap. The present invention is also relatively inexpensive to manufacture and assemble in part because a transparent window is not required. Further, because a complete tear through the front panel is not required, the overall structural integrity of the present invention is not compromised when the card flap is opened. Also, once the identification number has been read, the card flap and wallet card can be swung back into the closed position, thereby providing protection for the card. This also makes it less than apparent from the front of the package that the card flap was opened for activation, which is particularly beneficial when the wallet card is purchased as a gift. The present invention is also aesthetically pleasing before and after the card flap is opened because it does not require a partial window and does not require tears to be formed in the front panel. Further, after the wallet card is purchased, it is relatively easy to separate the card from the package because it is only necessary to peel the card away from the card flap. The front and rear panels do not need to be separated.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
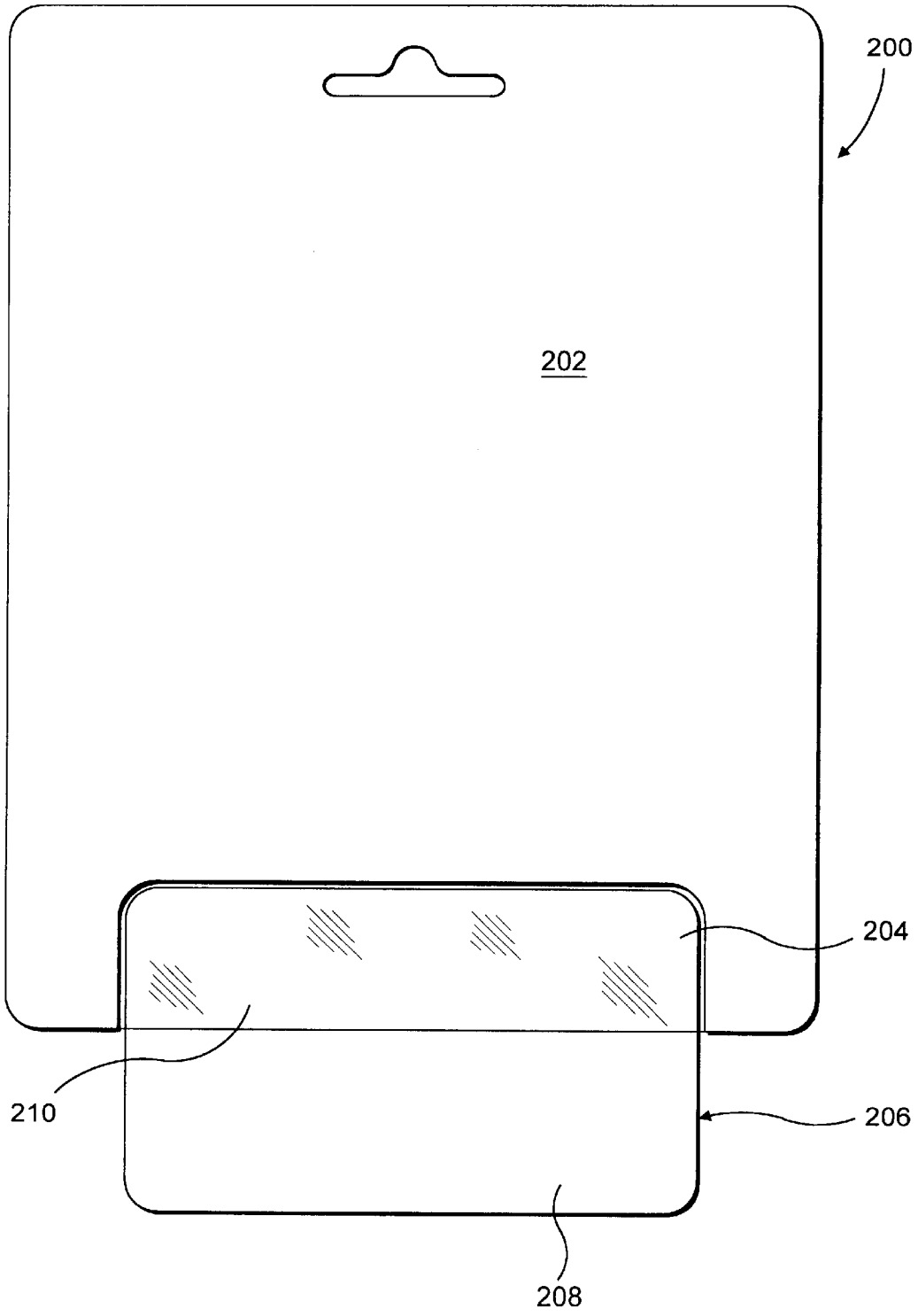
F I G. 1 PRIOR ART
FIG. 1 is a front plan view of a first wallet card package according to the prior art.
Figure 2:
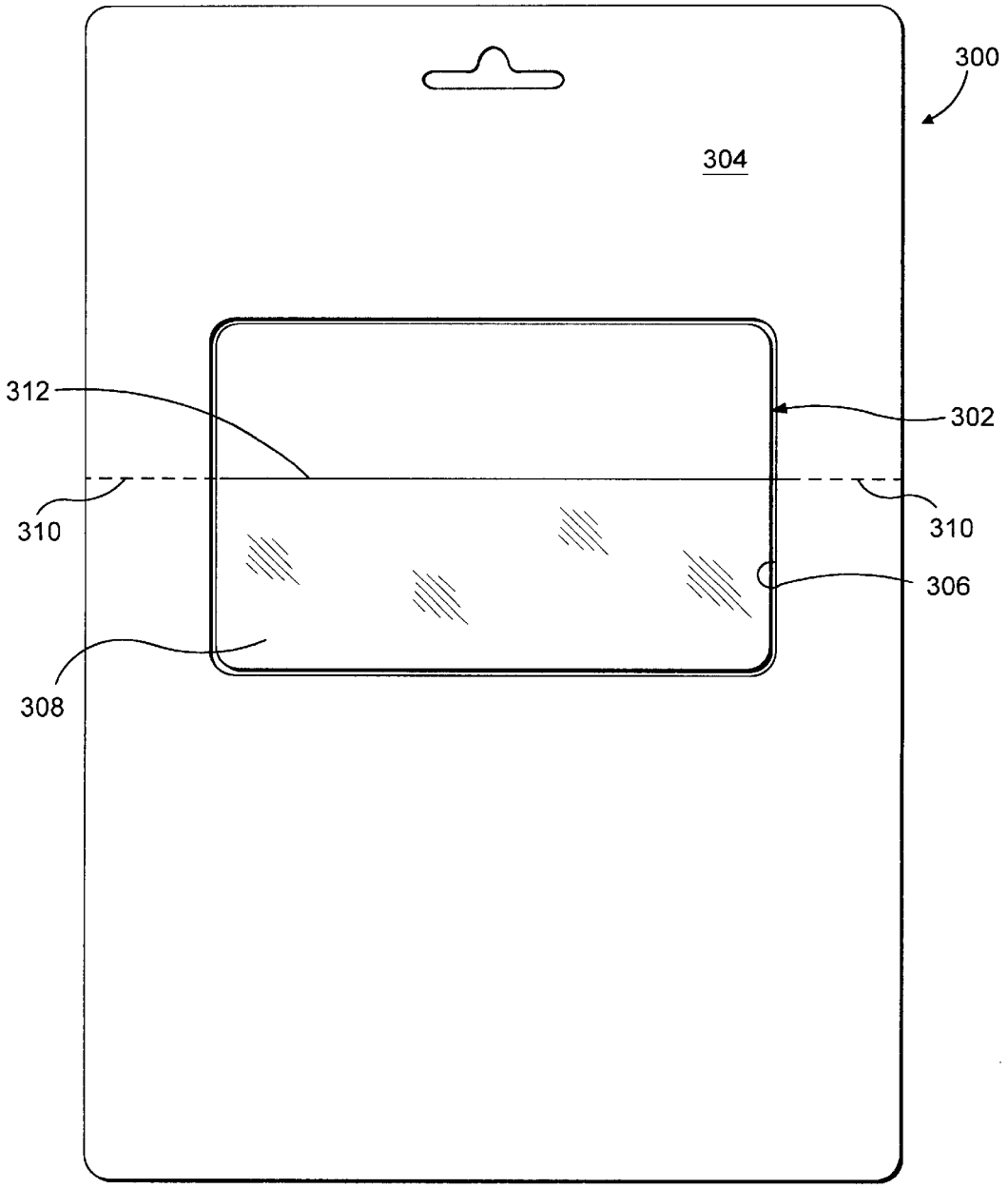
F I G. 2 PRIOR ART
FIG. 2 is a front plan view of a second wallet card package according to the prior art.
Figure 3:
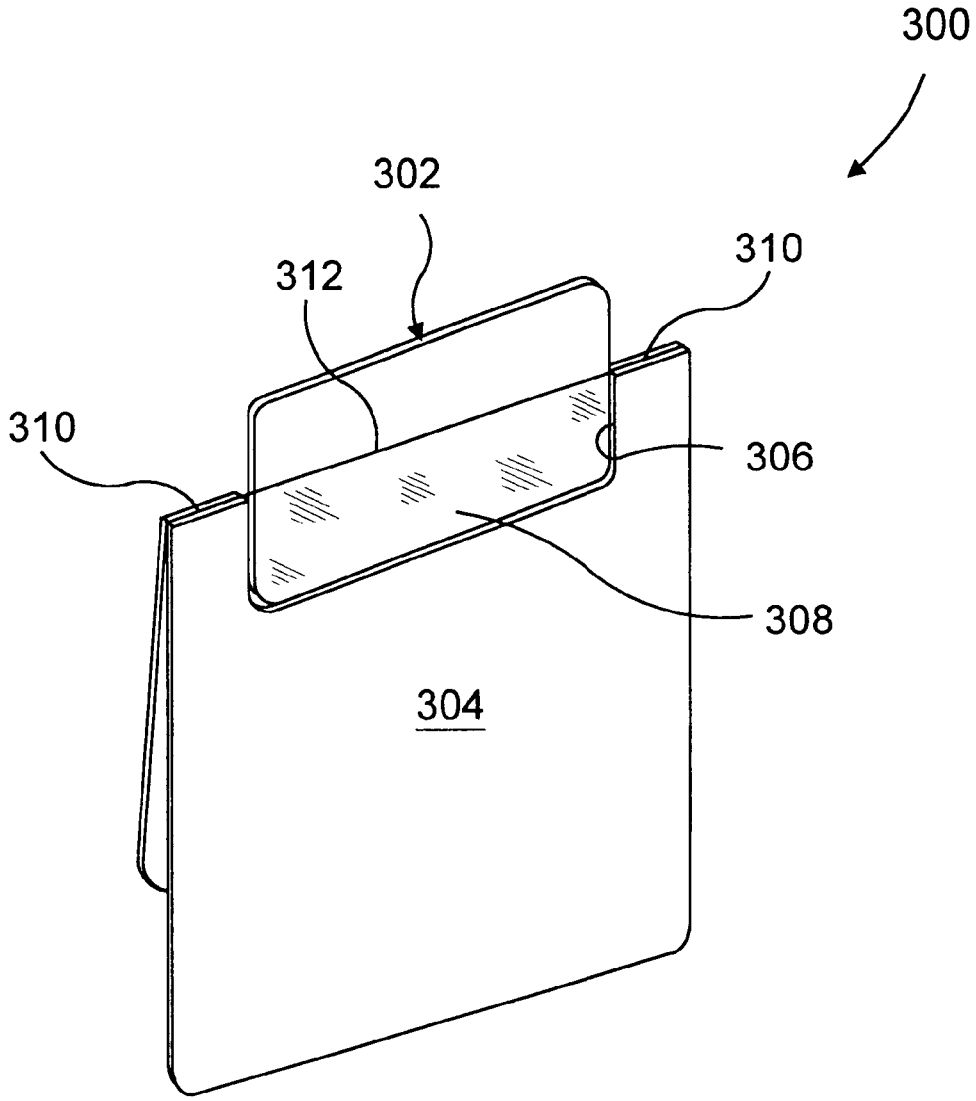
F I G. 3 PRIOR ART
FIG. 3 is a perspective view of the second wallet card package according to the prior art with the wallet card exposed.
Figure 4:
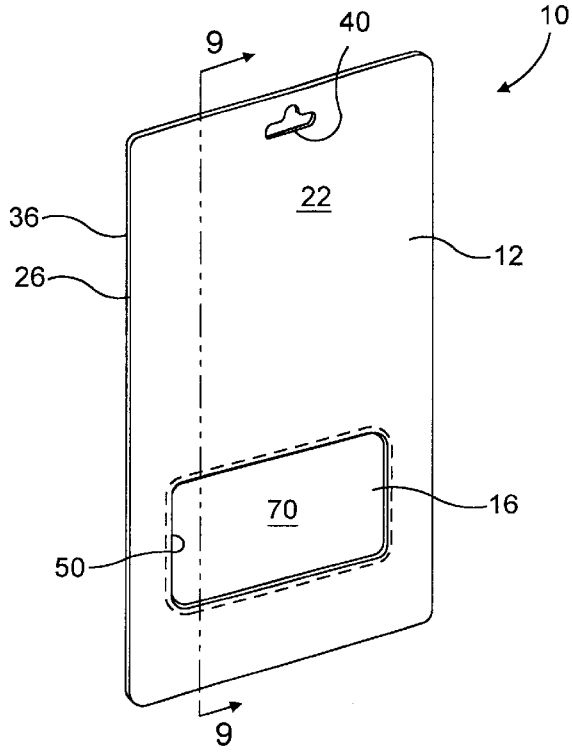
FIG. 4 is a front perspective view of the wallet card package of the present invention with the card flap in the closed position.
Figure 5A:
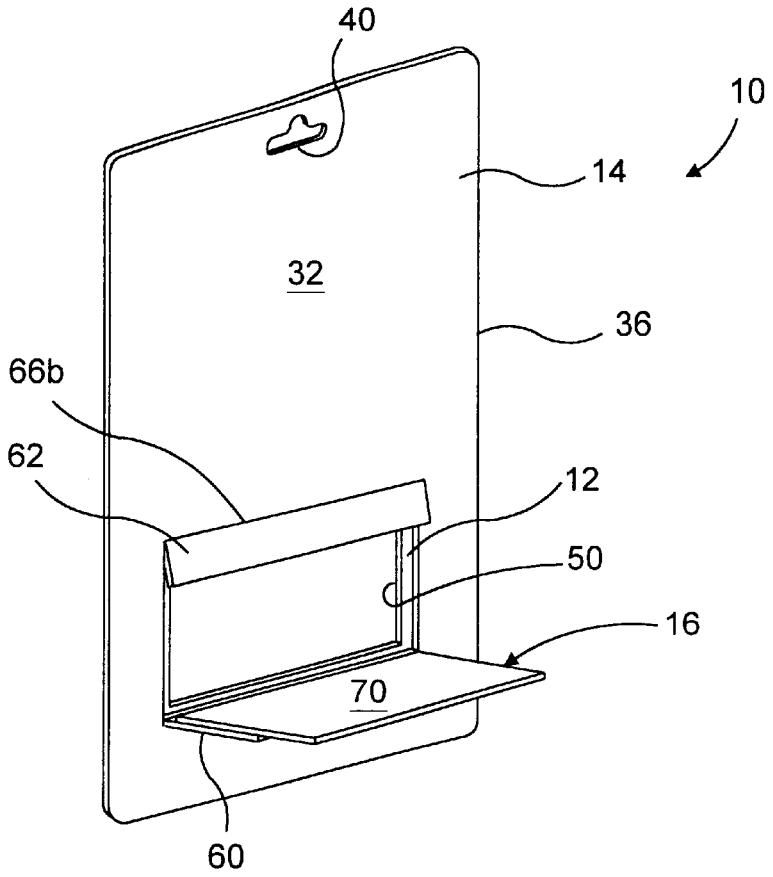
FIG. 5*a* is a rear perspective view of the wallet card package with the card flap in the open position.
Figure 5B:
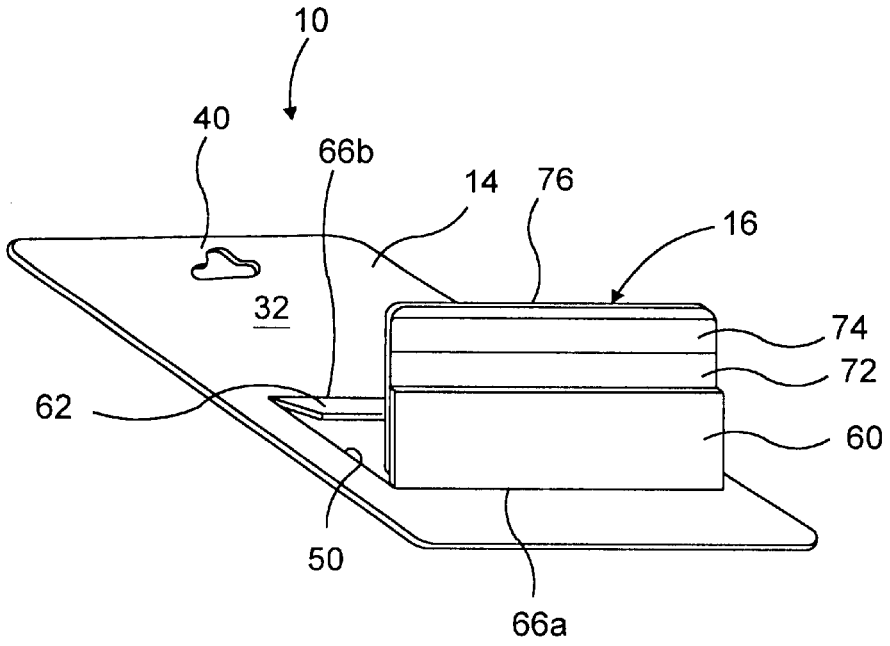
FIG. 5*b* is a rear perspective view of the wallet card package similar to FIG. 5*a* except from a different perspective.

A wallet card package according to a preferred embodiment of the present invention is illustrated in FIG. 4 and generally designated 10. The package 10 includes front 12 and rear 14 panels that close about and secure the wallet card 16. The front panel 12 defines an opening 50 that permits viewing of the wallet card 16. As shown in FIGS. 5*a–b,* wallet card 16 can be swung out from between the front 12 and rear 14 panels to facilitate point-of-sale activation. This permits the card 16 to be easily passed through a card reader without removing the card 16 from the package 10. For purposes of disclosure, and not by way of limitation, the present invention is described in connection with a pre-paid telephone card having its identification number stored in a magnetic strip. The present invention is well suited for use with other types of wallet cards, such as bank cards, credit cards, debit cards, rental cards, gift cards, information cards and other similar cards, and with other mechanisms for representing the identification number, such as bar codes.

Figure 9:
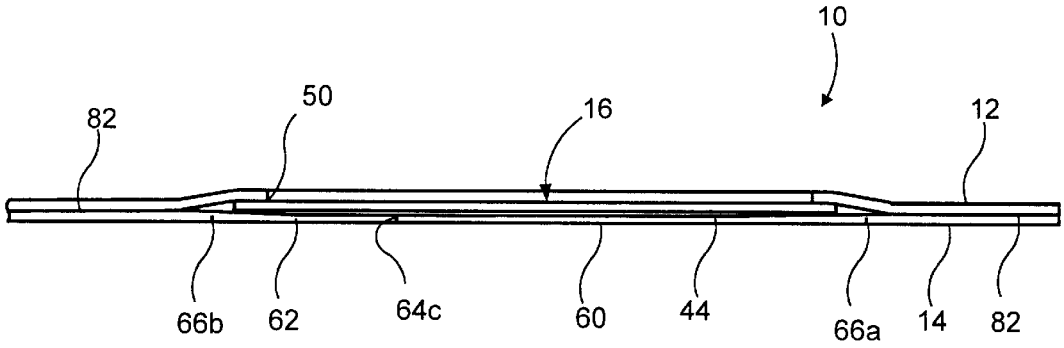
FIG. 9 is a partial sectional view taken along line IX—IX of FIG. 4 showing the wallet card disposed between the front and rear panels.
Figure 6:
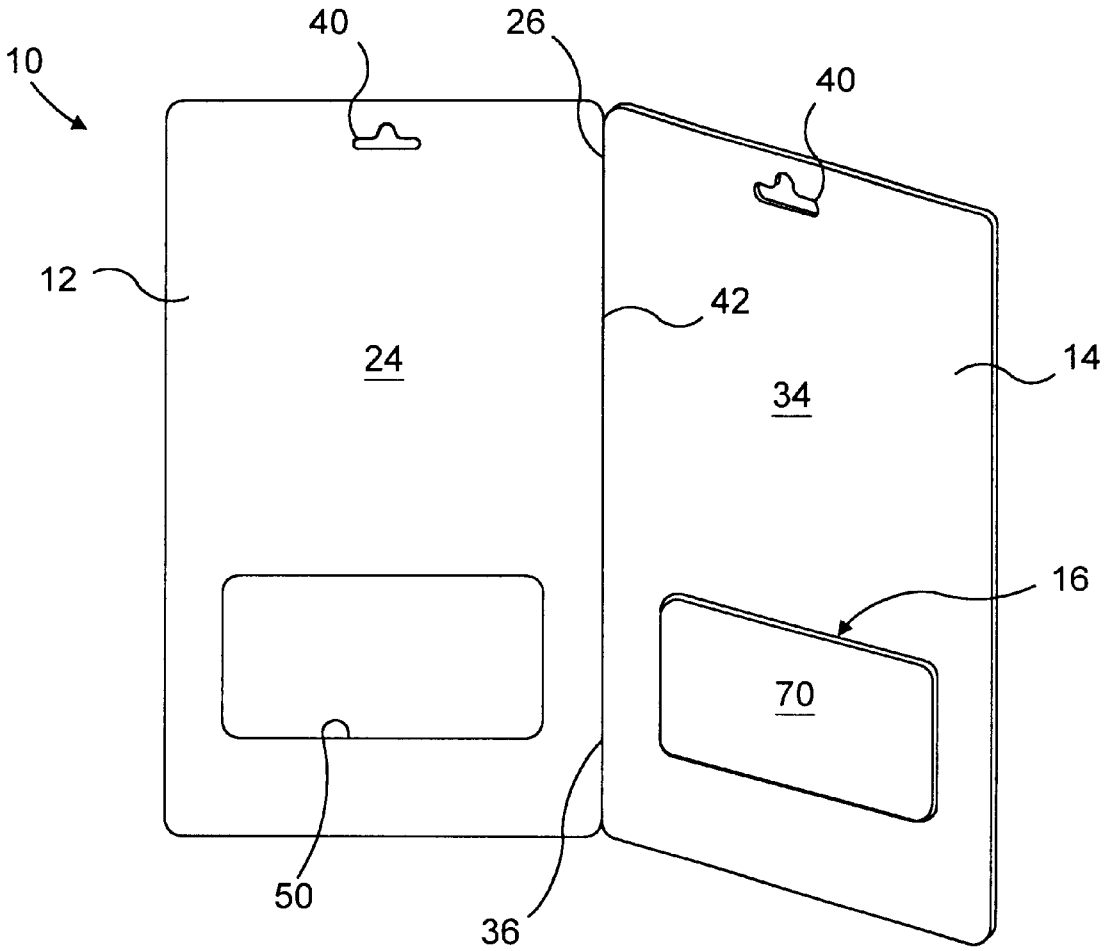
FIG. 6 is a front perspective view of the wallet card package with the panels open showing the wallet card secured to the rear panel.

Referring now to FIGS. 4 and 6, the front panel 12 is preferably a generally rectangular, planar sheet of paperboard. The front panel 12 includes a front major surface 22, a rear major surface 24 and a side edge 26. The front panel 12 defines a card opening 50 that permits viewing of the front surface 70 of the card 16. The opening 50 is preferably similar in shape to, but slightly smaller than, the periphery of the card 16. In the illustrated embodiment, the edges of the opening 50 extend substantially parallel to and approximately one-eighth of an inch inwardly from the edges of the card 16 (See FIG. 4, broken lines represent peripheral edge of card 16, and FIG. 9). As a result, the front panel 12 overlaps the card 16 approximately one-eighth of an inch around its entire periphery. This prevents the card 16 from being pulled forwardly through the opening 50 without damaging the package 10.

Figure 7:
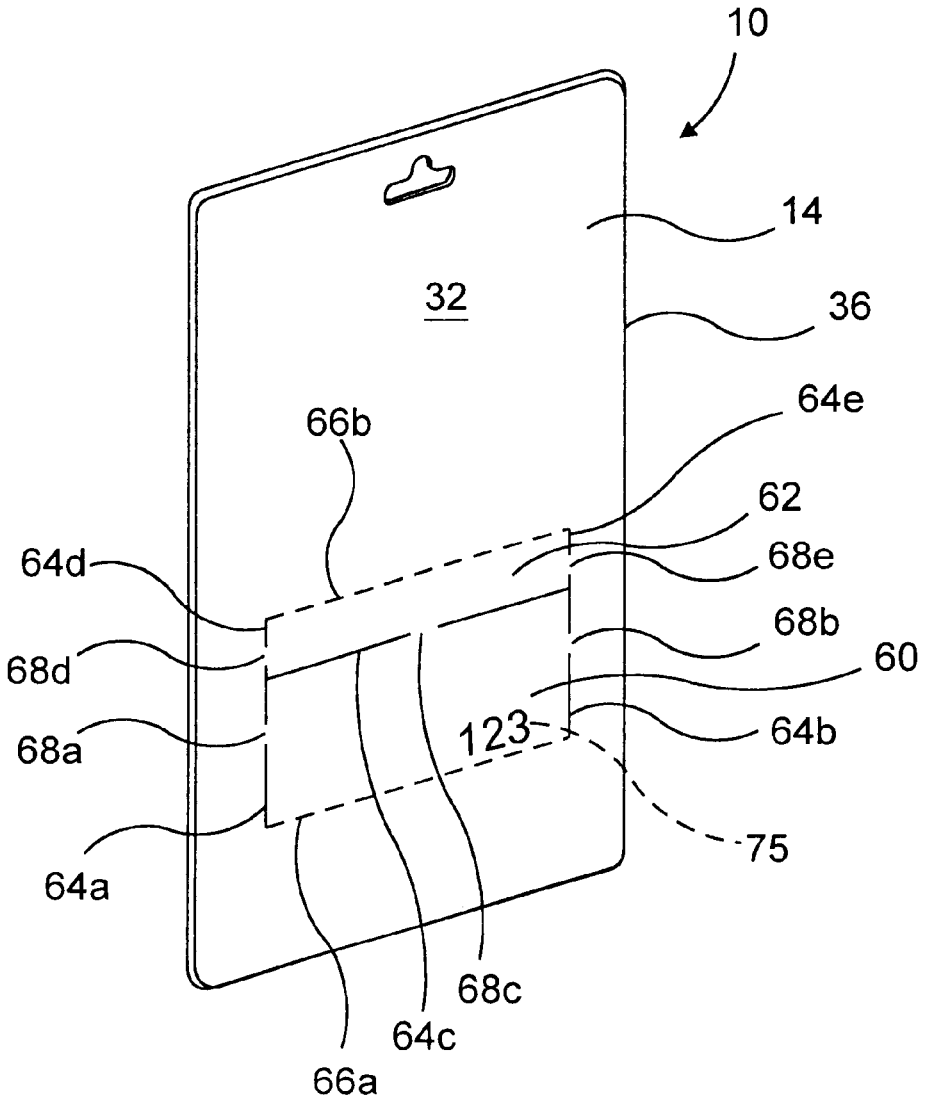
FIG. 7 is a rear perspective view of the wallet card package with card flap in the closed position.

The rear panel 14 is similar to the front panel 12, and is also preferably a generally rectangular, planar sheet of paperboard (See FIGS. 5*a–b* and 7). The rear panel 14 includes a front major surface 32, a rear major surface 34, and a side edge 36. As perhaps best shown in FIG. 7, the rear panel 14 includes a card flap 60 and a cover flap 62, both of which are defined by a plurality of cut lines 64*a–e*. A plurality of bridges 68*a–e* remain across of the cut lines 64*a–e* such that the flaps 60 and 62 are held in the closed positioned until appropriate rearward force is applied to the card 16. The size, location and number of bridges can be varied from application to application to provide the desired resistance to opening. In some applications, the bridges can be eliminated and the inherent resistance of the card 12 to folding can be relied upon to retain the card flap 60 in the closed position until it is forcably opened for activation. Alternatively, the partial cut line 64*a–e* can be replaced by perforations (not shown) or the like. As shown, the cover flap 60 and cover flap 62 are intended to fold or swing out from the rear panel 14 when the card 16 is pushed rearwardly. Score lines or fold lines 66*a–b* are preferably formed in the rear panel 14 to facilitate folding of the flaps 60 and 62 along the desired line. The respective sizes of the card flap 60 and cover flap 62 will vary from application to application. The card flap 60 is preferably sized and configured so that it does not interfere with passage of the card 16 through a conventional card reader. For example, the upper edge of the card flap 60 preferably terminates a sufficient distance from the magnetic strip 74 so that it is not required to pass through the card slot on the card reader (not shown). In applications where the card slot is of sufficient width to receive both the card 16 and card flap 60, this is not an issue. In some applications, the card flap 60 may define an opening (not shown) permitting viewing of a control number printed on the rear surface of the card 16.

As perhaps best illustrated in FIG. 6, the front 12 and rear 14 panels are adjoined along side edges 26 and 36, respectively, at fold line 42. Alternatively, the front 12 and rear 14 panels can be adjoined along a different edge or can be separate, unconnected pieces. Obviously, the shape of the panels can vary from application to application as desired. For example, the front and rear panels can be different in shape and/or size from each other. Also, the front and/or rear panels can include embossing in the shape of the card 16 to help locate the card in the package 10.

The wallet card 16 is generally conventional, and is preferably manufactured from a sheet of plastic material. The card 16 includes a front surface 70, a rear surface 72 and a magnetic strip 74. The magnetic strip 74 is applied to the rear surface 72 of the card 16 adjacent its upper edge 76, such that the magnetic strip 74 is easily passed through a card reader when the card flap 60 is open (as described below). In addition to the magnetic strip 74, a pin number 75 is preferably printed on the rear surface 72 of the card 16 in a location, for example, below the card flap 60, where the pin number 75 remains hidden from view until the wallet card 16 is completely removed from the package 10. For purposes of illustration, the pin number 75 is shown in FIG. 7 in hidden lines. The dimensions of the wallet card 16 will vary from application to application as desired. Also, if desired, the magnetic strip 74 can be replaced by a bar code or other form of identification—preferably a machine-readable form of identification. The wallet card 16 is secured to the package 10 by a layer of peelable adhesive 44. The layer of adhesive 44 is disposed between the card flap 60 and the card 16 (See FIG. 9). The preferred adhesive is either a hot melt or a cold glue. A suitable hot melt is available from L&D Adhesives of Comstock Park, Mich. under the trade name INSTANT-LOK. Suitable cold glues include formulated rubber latex available from L&D Adhesives under the trade name National 35-6148 and compounded natural rubber latex available from P-H-X, Inc. Of Milwaukee, Wis. under the trade name PHX 4011. The peelable adhesive 44 is characterized by its relatively high shear strength and relatively low peel strength. The low peel strength permits the card 16 to be easily peeled up from the package 10 when the panels 12 and 14 are separated. Alternatively, as desired, the card 16 can be secured to the card flap by other conventional methods.

A display hole 40 is defined toward the top edge of each panel. The two holes 40 are aligned to form a single hole when the package 10 is closed. The display hole 40 is used for hanging the package 10 from a conventional display hook (not shown). Obviously, the hole 40 can be eliminated if desired.

If desired, a transparent window (not shown), such as a transparent plastic film, can be secured in the opening 50 to protect the front surface of the card 16. To facilitate opening of the card flap (as described below), the transparent window is preferably secured to the front panel 12 along only one edge. This permits the transparent window to give as the card 16 is pushed rearwardly from the front side.

Manufacture and use

Figure 8:
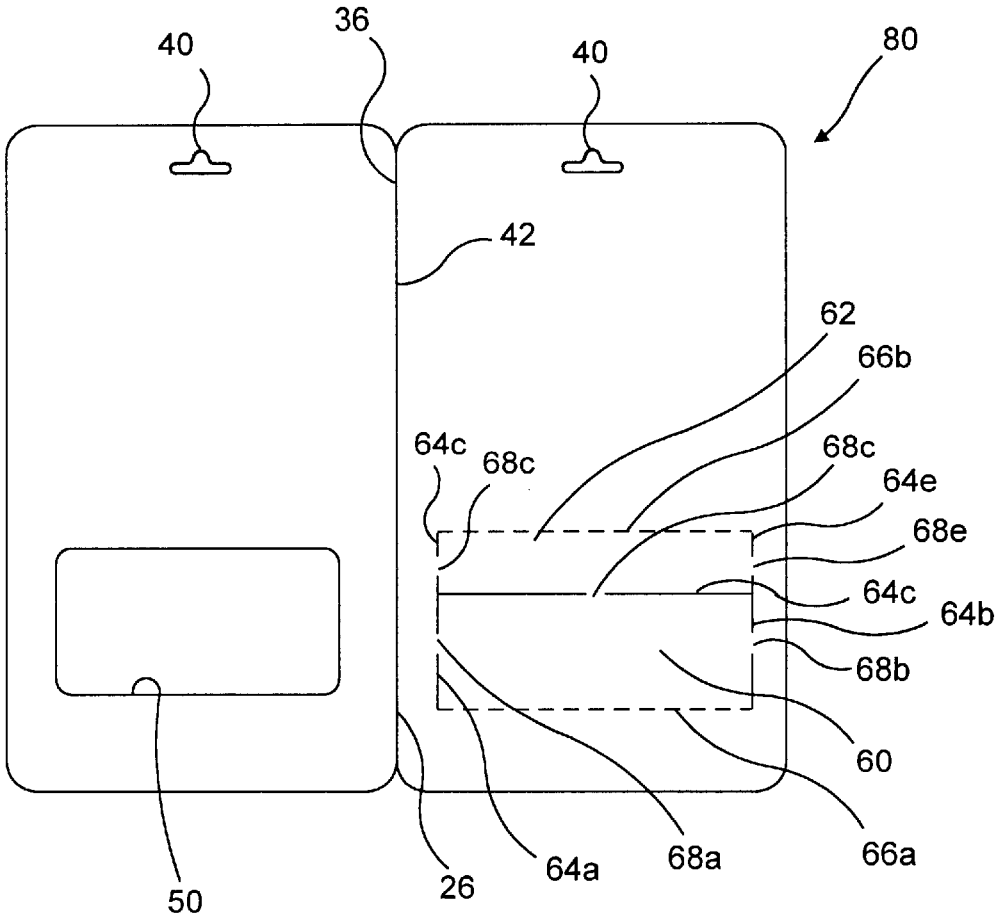
FIG. 8 is a top plan view of a blank for forming the wallet card package.

Referring now to FIG. 8, the package 10 is manufactured from a conventional die cut paperboard blank 80. The desired printed information can be applied to the blank 80 either before or after the die cutting operation. The blank 80 is cut with front 12 and rear 14 panels adjoined along fold line 42. The fold line 42 can be scored or partially cut during die cutting process to facilitate the formation of a straight consistent fold. The front panel 12 is also die cut with opening 50. As noted above, the opening 50 is preferably smaller than the card 16. The rear panel 14 is die cut with cut lines 64*a–e* that define card flap 60 and cover flap 62. More specifically, card flap 60 is defined by cut lines 64*a–c* and cover flap 62 is defined by cut lines 64*c–e*. As best seen in FIG. 7, the cut lines 64*a–e* include intermittent bridges 68*a–e* that hold the flaps 60 and 62 closed. As noted above, in some applications, the intermittent bridges 68*a–e* may be eliminated and the inherent resistance of the card 12 to folding can be relied upon to retain the card flap 60 in the closed position until it is forcably opened for activation. If some applications, the cut lines 64*a–e* may be replaced by perforations or partial cut lines (i.e. cut lines in which the cut does not extend entirely through the panel) or the like. Crease lines 66*a–b* are also formed in the rear panel 14 during the die cutting step to facilitate a clean, straight fold of the card flap 60 and the cover flap 62. The crease or score lines 66*a–b* can be eliminated, if desired, and the fold line can be defined as the card flap 60 is opened for the first time. In addition, the display holes 40 are cut in the panels 12 and 14 during die cutting to permit the package to be hung for display from a conventional display hanger (not shown). Alternatively, the front 12 and rear 14 panels can be die cut as separate elements or they can be adjoined to each other along a different edge. The term "retention means" as used in the claims shall include not only intermittent bridges, partial cut lines, perforations and other weakened lines, but shall also include, without limitation, the inherent tendency of the panel to resist folding or bending.

The wallet card 16 is manufactured using conventional techniques and apparatus. The front surface 70 of the card 16, which is visible through the opening 50 in the front panel 12, is printed with the desired graphics. The rear surface 72 of the card 16 is provided with both a magnetic strip 74 and a pin number 75. The magnetic strip 74 is secured to the card in a conventional manner and is encoded with an identification number using conventional techniques and apparatus. The pin number 75 is preferably printed on the lower half of the card 16 where it is hidden from view until the card 16 is separated from the package 10. As noted above, the pin number 75 is shown in FIG. 7 in hidden lines to show its approximate position on the rear of the card 16. As noted above, the magnetic strip 74 can be replaced by other types of identification, including other machine-readable forms of identification, such as a bar code.

Once the package 10 is die cut, the peelable adhesive 44 is applied to the front surface 32 of the rear panel 14 on the card flap 60 using conventional techniques and apparatus. Alternatively, the adhesive 44 can be applied to the rear surface 72 of the card 16. The card 16 is then secured to the package 10 by placing it into position on the card flap 60 with its upper portion extending over (but not secured to) the cover flap 62. The card 16 can alternatively be secured to the card flap 60 by adhesive tape, double sided tape or other conventional securing mechanisms.

A layer of adhesive or cement 82 is then applied to either or both of the front and rear panels using conventional techniques and apparatus. The die cut blank 80 is then folded along fold line 42 using conventional folding machinery. The front panel 12 folds down over the rear panel 14 and card 16 to complete the package 10. The cement 82 secures the panels 12 and 14 in the folded position.

Alternatively, the cement 82 can be eliminated and the front 12 and rear 14 panels can be sealed together using an alternative technique. For example, the two panels can be intersecured by a heat activated adhesive that is pre-applied to the blank 80. When a heat activated adhesive is used, the two panels are folded and then sealed together by selectively applying heat and pressure to the panels. As a second example, the front 12 and rear 14 panels can be intersecured by applying a layer of peelable adhesive to the entire face of either or both of the front 12 and rear 14 panels, except the cover flap 62. In this embodiment, the layer of peelable adhesive secures the panels together and secures the card to the card flap 60.

In the completed package 10, the cemented front 12 and rear 14 panels entrap card 16 with its front surface 70 visible through opening 50. Prior to purchase, for example, when the package 10 is on display, the card 16 is in an inactive state, and the card flap 60 and cover flap 62 are both in the closed position. When the card 16 is purchased, it is necessary to activate the card 16. The activation process is well-known and will not be described in detail. Suffice it to say that the card 16 is activated by reading the identification number encoded on the magnetic strip 74 and communicating that number to a central computer (not shown). The central computer activates the card 16 and maintains an accounting of the card's value. Once the card's value has been depleted, the card 16 is typically deactivated by the central computer. To activate the card 16, it is necessary to obtain access to the magnetic strip 74. Access to the magnetic strip 74 is obtained by applying a rearward force to the front surface 70 of the card 16. This force is, in turn, applied to the card flap 60 and the cover flap 62. Once sufficient force is applied, the bridges 68*a–e* are ruptured or broken and the card flap 60 and cover flap 62 are free to swing rearwardly away from the package 10. The card 16 is then swung rearwardly into the open position substantially perpendicular to the plane of the package 10. In use, the intersecured card 16 and card flap 60 swing inwardly and outwardly together. The cover flap 62, which initially covers the magnetic strip 74, swings rearwardly and out of the way as the card 16 and card flap 60 are swung into the open position. This exposes the magnetic strip 74 located on the upper half of the card 16. The exposed strip 74 can then be passed through a conventional magnetic strip card reader (not shown) while it remains attached to the card flap 60. For example, the card 16 is preferably held in the open position substantially perpendicular to the plane of the package 10 while the upper end of the card 16 is passed through the card reader. Once the card 16 is activated, the card flap 60 can be returned to the closed position by manually swinging the cover flap 62 out of the way and swinging the card 16 and card flap 60 back into the plane of the package 10. The cover flap 62 is then released so that it partially closes by virtue of its inherent tendency to return to the closed position. As a result, the cover flap 62 helps to retain the card flap 60 in the closed position after it has been opened.

Eventually, it will be desirable to remove the wallet card 16 from the package 10 so that it can be easily carried, for example, in a wallet. To remove the card 16, the card 16 and card flap 60 are swung into the open position against the bias of the cover flap 62. Once the card 16 has cleared the cover flap 62, the card 16 is separated from the card flap 60 by simply peeling the card 16 up from the peelable adhesive 44 to separate it from the card flap 60. The low peel strength of the peelable adhesive 44 permits relatively easy removal of the card 16.

Alternative Embodiments

Figure 10:
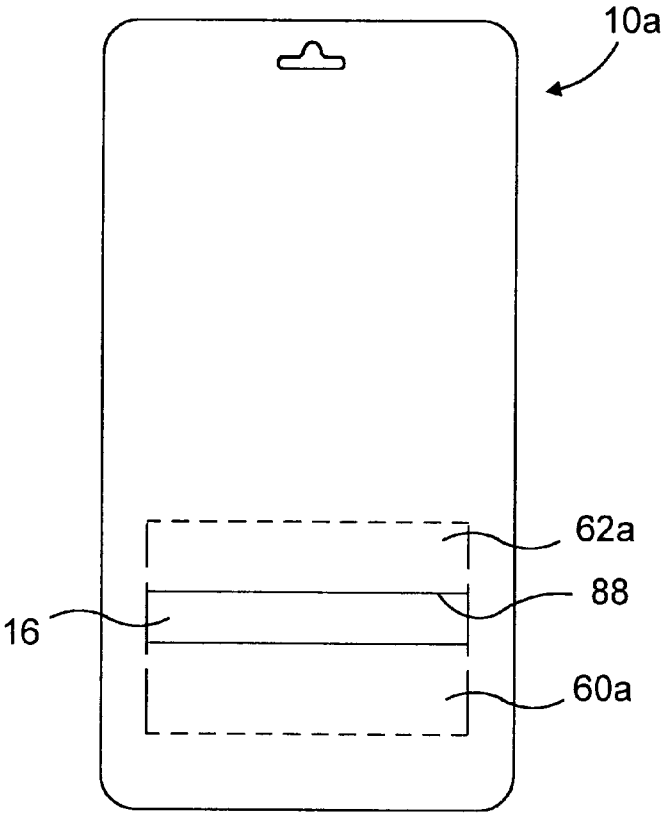
FIG. 10 is a rear plan view of a first alternative wallet card package.

In a first alternative embodiment illustrated in FIG. 10, package 10*a* is provided with modified card and cover flaps, 60*a* and 62*a*, respectively. As shown, the card flap 60*a* and cover flap 62*a* are configured to provide an opening 88 therebetween. The opening 88 permits viewing of graphics or other printed material on the rear of the card 16 and also provides additional space between the upper edge of the card flap 60*a* and the magnetic strip (not shown), which in some applications may be necessary to permit the card 16 to be passed through a card slot of a card reader.

Figure 11:
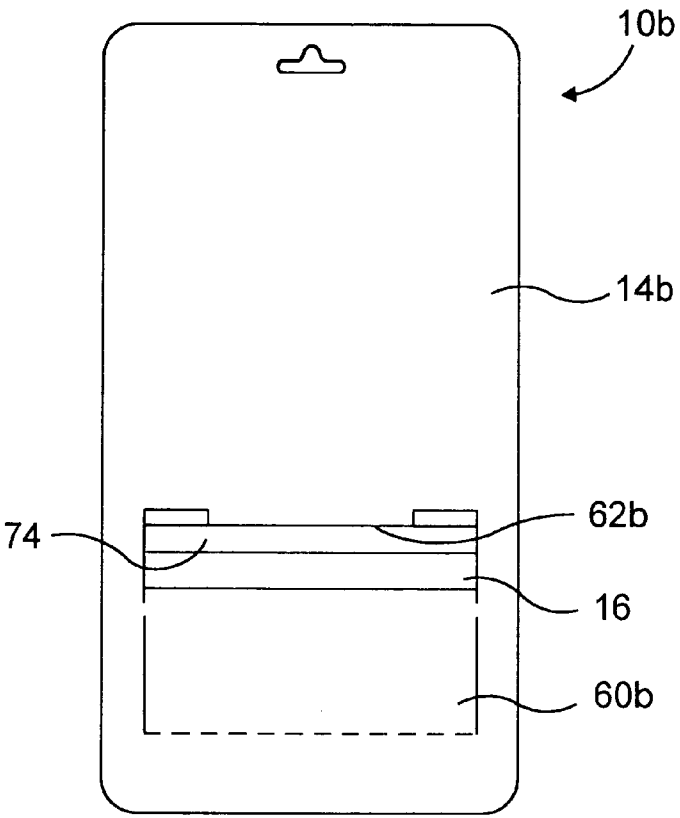
FIG. 11 is a rear plan view of a second alternative wallet card package.

In a second alternative embodiment shown in FIG. 11, package 10*b* is provided with a modified cover flap 62*b* that permits viewing of the magnetic strip 74 even when the card flap 60*b* is in the closed position. In this embodiment, the cover flap 62*b* is a narrow tab that is substantially narrower than the cover flap 62 of the preferred embodiment. The cover flap 62*b* is designed not to fold when the card 16 is moved into the open position. Instead, the cover flap 62*b* and card 16 are designed to flex or bow when the card 16 is pushed rearward until the card 16 pops out from between the front 12*b* and rear 14*b* panels.

Figure 12:
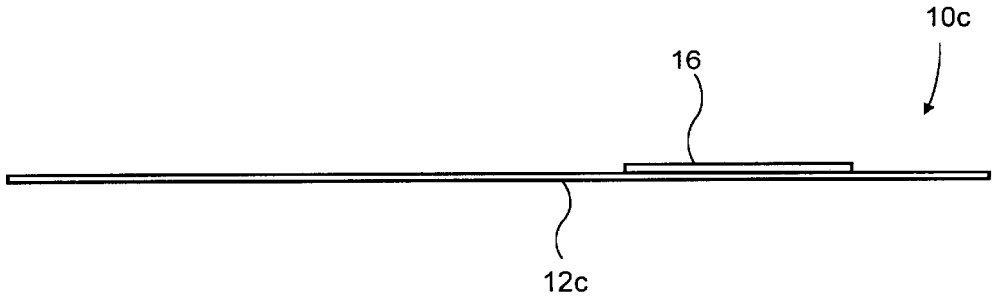
FIG. 12 is a side elevational view of third alternative wallet card package.
Figure 13:
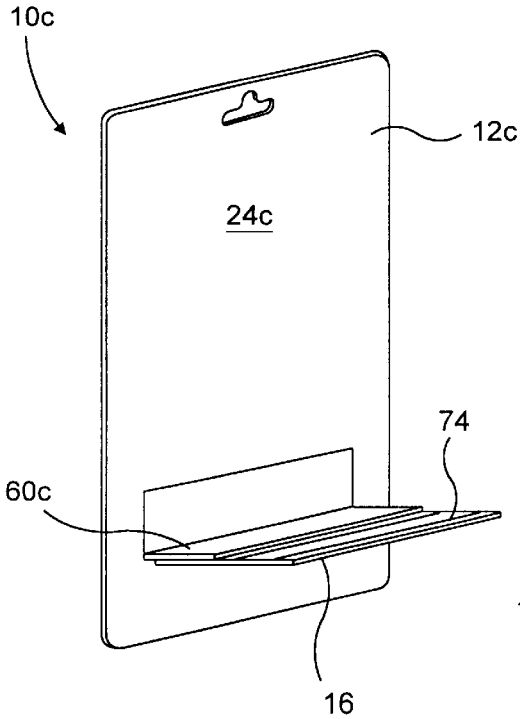
FIG. 13 is a front perspective view show the third alternative wallet card package with the card flap in the open position.
Figure 14:
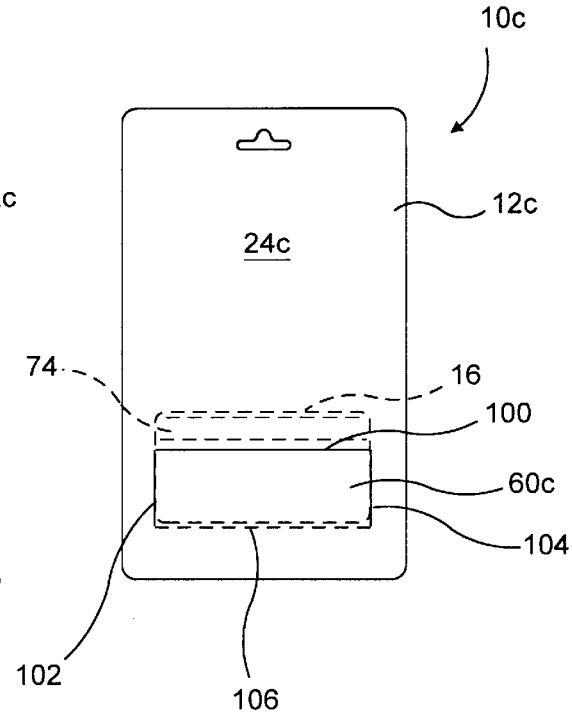
FIG. 14 is a rear elevational view of the third alternative wallet card package.

In a third alternative embodiment shown in FIGS. 12–14, the wallet card package 10*c* includes only a single panel 12*c* and the card flap 60*c* is adapted to swing forwardly rather than rearwardly as in the previously disclosed embodiments. In this embodiment, the card 16 is secured directly to the front surface 24*c* of the panel 12*c* by a layer of peelable adhesive 44 or other conventional mechanisms. The panel 12*c* includes a series of three cut lines 102, 104 and 106 that define the card flap 60*c* (See FIG. 14). Also, a crease or score line 106 can be defined along the bottom of the card flap 60*c* to facilitate a clean, straight fold of the card flap 60*c*. The card flap 60*c* is dimensioned to extend over only a lower portion of the card 16 so that the magnetic strip 74 is exposed when the card flap 60*c* is folded into the open position (See FIG. 13). As shown, no cover flap is required in this embodiment because the card flap 62*c* folds forwardly rather than rearwardly. If desired, the panel 12*c* may include an opening permitting viewing of a portion of the rear surface of the card 16.

Figure 15:
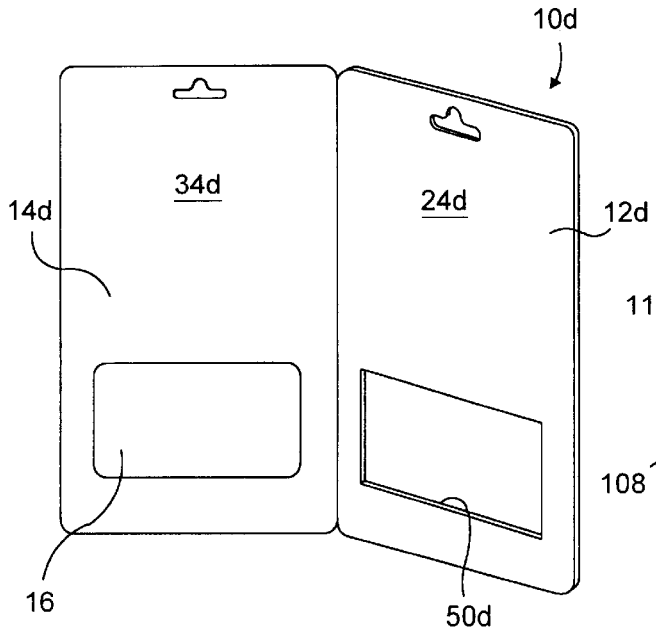
FIG. 15 is a front perspective view of a fourth alternative wallet card package with the panels open showing the wallet card secured to the rear panel.
Figure 16:
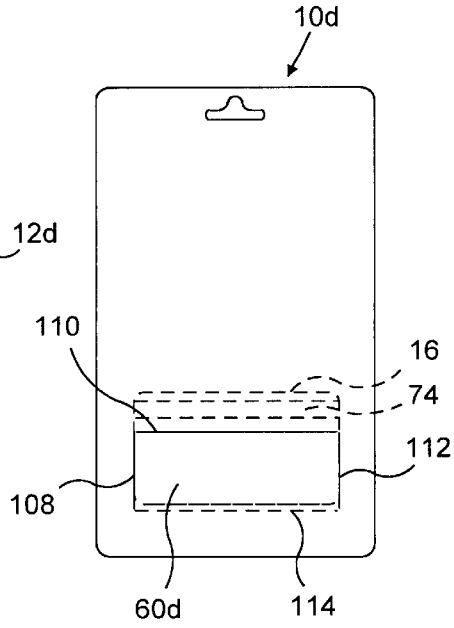
FIG. 16 is a rear elevational view of the fourth alternative wallet card package.
Figure 17:
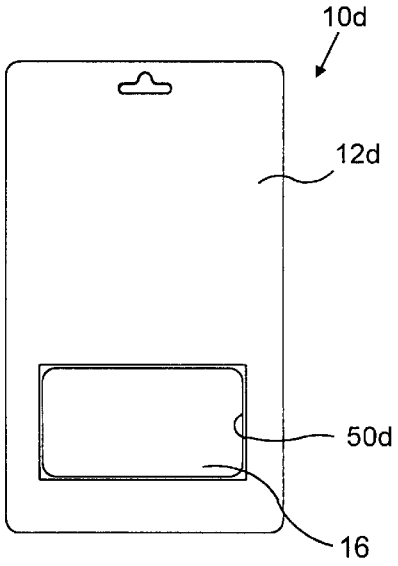
FIG. 17 is a front elevational view of the fourth alternative wallet card package.

A fourth alternative embodiment is shown in FIGS. 15–17. In this embodiment, the package 10*d* includes front 12*d* and rear 14*d* panels, and the card flap 60*d* is adapted to swing forwardly into the open position. The card 16 is secured to the front surface 34*d* of the rear panel 14*d*. The front panel 12*d* defines an opening 50*d* that is large enough to permit the card 16 to pass therethrough when the card flap 60*d* is swung forwardly into the open position. The opening 50*d* may be slightly smaller than the card 16 or the card flap 60*d* in one or more locations so that the front panel 12*d* provides some resistance to movement of the card flap 60*d* into the open position. The card flap 60*d* is defined by cut lines 108, 110 and 112. Also, a crease or score line 114 can be defined along the bottom of the card flap 60*d* to facilitate a clean, straight fold of the card flap 60*d*, if desired. Intermittent bridges (not shown) can be provided, if desired, to help retain the card flap 60*d* in the closed position.

Figure 18:
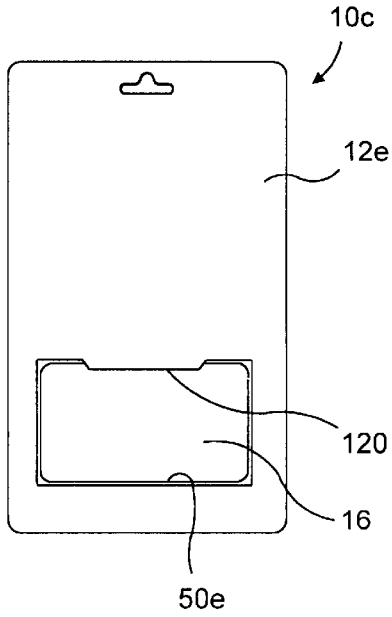
FIG. 18 is a front elevational view of a fifth alternative wallet card package.

A fifth alternative embodiment is shown in FIG. 18. This embodiment is generally identical to the fourth alternative embodiment, except that the front panel 12*e* includes a card retention tab 120 that helps to retain the card flap 60*d* in the closed position until it is forcably swung forwardly into the open position. The package 10*e* includes a front panel 12*e* defining opening 50*e*. The opening 50*e* is shaped to define a card retention tab 120 that partially overlaps the card 16. The precise size, shape and location of the tab 120 will vary from application to application as desired.

The foregoing descriptions disclose various embodiments of the present invention in which the card flap is hinged or foldably joined to the panel along its bottom edge below card 16. It should be readily appreciated and understood that the card flap can alternatively be hinged or foldably joined to the panel along its upper edge above card 16. Hinging the card flap along its upper edge is particularly useful when the identification number (e.g. the magnetic strip or bar code) is located toward the bottom edge of the card rather than toward the top edge.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. A wallet card package, comprising:

a first panel (12*c*) defining a first plane and including a card flap (60*c*) joined to said first panel (12*c*) along a score line (106), said card flap (60*c*) being selectively pivotal in a single direction about said score line (106) such that said package is selectively movable between a closed position in which said card flap (60*c*) is in substantial alignment with said first plane and an open position in which said card flap (60*c*) is swung out and away from said front panel (12*c*) along said score line (106) so that said card flap (60*c*) is substantially outside of said first plane and defines a second plane distinct from said first plane; and a wallet card (16) removably secured to said card flap (60*c*) and moveable in conjunction with said card flap (60*c*) between said first plane and said second plane, said wallet card having a front surface (70) and a rear surface (72) including identification means (74) on said rear surface (72), said identification means (74) being exposed and capable of being activated when said package is in said open position.

2. The wallet card package of claim 1, wherein said card flap is movable in a forward direction toward a front surface of the first panel.

3. The wallet card package of claim 2, further comprising a retention means for providing resistance against movement of the card out of the first plane.

4. The wallet card package of claim 3, wherein the retention means comprises at least one bridge.

5. The wallet card package of claim 3, further comprising an opening disposed on a rear surface of said first panel (12*c*) to permit viewing of a portion of said rear surface (72) of said wallet card (16), wherein said retention means is defined by said opening (50*d*) disposed in said first panel (12*d*) being slightly smaller than perimeter dimensions of said wallet card (16) so that said first panel (12*d*) provides some resistance to the movement of card flap (60*d*) into said open position.

6. The wallet card package of claim 3, wherein the retention means is defined by said first panel (12*d*) further including a card retention tab (120) that assists in retaining said card flap (60*d*) in said closed position until said card flap (60*d*) is forcibly moved forwardly into said open position.

7. The wallet card package of claim 3, wherein said front panel (14) further includes a cover flap (62) as said retention means; said cover flap (62) covering at least a portion of said card (16) that is uncovered by said card flap (60) when said card flap (60) and said card (16) are in said first position, said first panel (14) further defining an opening (50) permitting viewing of a surface of said card (16) when said card flap (60) and said card (16) are in said first position.

8. The wallet card package of claim 1, wherein said card flap (60) is defined by at least one cut line (64); said card flap (60) temporarily retained in said first position by at least one bridge (68).

9. The wallet card package of claim 7, wherein said cover flap (62) and said card flap (60) substantially cover a surface of said card (16) when said card (16) and said card flap (60) are in said first position.

10. The wallet card package of claim 8, wherein said cover flap (62) covers said identification means (74) when said card (16) and said card flap (60) are in said first position.

11. The wallet card package of claim 1, wherein the first panel is defined as a rear panel, the package further comprising a front panel (12*b*);

the rear panel (14*b*) interconnected with said front panel (12*b*), a card retention means present on said rear panel (14*b*) for providing resistance to movement of said card out of the first plane; and the wallet card (16) disposed between said front panel (12*b*) and said rear panel (14*b*), said wallet card (16) rearwardly moveable away from said front panel (12*b*) in conjunction with said card flap (60*b*).

12. The wallet card package of claim 11, wherein the retention means comprises a cover flap joined to said rear panel along a second fold line, said cover flap being selectively pivotal about said second fold line in a rearward direction such that in a closed position, the card flap and the cover flap are in substantial alignment with the first plane, and in an open position, the cover flap and the card flap are swung out rearwardly.

13. The wall card package of claim 9, wherein said retention means comprises at least one tab which is structured to flex without folding when said wallet card (16) is moved from said first plane to said second plane.

14. The wallet card package of claim 9, wherein said wallet card (16) can be viewed through an opening (50) disposed within said front panel (12) when said package is in said closed position, said opening (50) being similar in shape to, but slightly smaller than, the periphery of said wallet card (16) whereby said card (16) is prevented from passing through said opening (50).

15. The wallet card package of claim 9, wherein said identification means (74) is not covered by said card flap (60) when said package is in said open position.

16. The wallet card package of claim 12, wherein said cover flap (62) covers at least a portion of said rear surface (72) of said wallet card (16) when said package is in said closed position.

17. The wallet card package of claim 1, wherein said wallet card (16) is secured to said card flap (60) by a peelable adhesive (44).

18. The wallet card package of claim 12, wherein said card flap (60) is defined by at least one cut line (64), said card flap (60) temporarily retained in substantial alignment with said first plane by at least one bridge (68), wherein said cover flap (62) is further defined by at least one cut line (64), said cover flap (62) temporarily retained in substantial alignment with said first plane by at least one bridge (68).

19. The wallet card package of claim 12, wherein said cover flap (62) and said card flap (60) substantially cover said rear surface (72) of said wallet card (16) when said package is in said closed position.

20. The wallet card package of claim 12, wherein said cover flap (62) covers said identification means (74) when said package is in said closed position.

21. The wallet card package of claim 1, wherein said wallet card (16) includes a pin number (75), said pin number (75) hidden from view when said package is in said closed position.

22. The wallet card package of claim 1, wherein said first panel (12) comprises a display hole (40) for hanging said package at a point of display.

23. The wallet card package of claim 11, wherein said front panel (12) and said rear panel (14) each include a respective side edge (26,36), said front panel (12) and said rear panel (14) being integrally connected at said edges (26,36) along a fold line (42).

24. The wallet card package of claim 12, wherein said cover flap **(62*a*) and said card flap (60*a*) define an opening (88) there between and partially cover the rear surface (72) of wallet card (16)**.

25. A method for activating a packaged wallet card, comprising the steps of:

providing a package with a wallet card disposed on a panel, the panel including a card flap that is pivotal about a fold line, the package including retention means for temporarily retaining the card flap in a plane defined by the first panel, the card being secured to and carried by the card flap, the card including an identification means for identifying the card for activation purposes;

applying a force to at least one of the card and the card flap to overcome the retention means;

swinging the card and the card flap into an open position out of the plane defined by the first panel;

reading the identification means while the card and the card flap are in the open position and while the card remains attached to the card flap; and activating the card in a central computer based on the identification means.

26. The method of claim 25 wherein the retention means is defined as at least one bridge, said applying step including applying sufficient force to the card through the opening to break the bridge.

27. The method of claim 26 wherein the first panel includes a cover flap covering the identification means, the cover flap being pivotal about a fold line, said swinging step including swinging the card into an open position such that the identification means is exposed.

28. The method of claim 27 wherein the first panel includes retention means for temporarily retaining the cover flap in the plane defined by the first panel, said applying step including applying sufficient force to the card through the opening to overcome the cover flap retention means.

29. The method of claim 28 wherein the cover flap retention means is defined as at least one bridge, said applying step including applying sufficient force to the card through the opening to break the cover flap bridge.

* * * * *